United States Patent [19]

Kosaka et al.

[11] 3,944,695

[45] Mar. 16, 1976

[54] HEAT PRINTING SHEET

[75] Inventors: Yujiro Kosaka, Tokyo; Hitoshi Kuroki, Yokohama; Masakuni Kawasaki, Ichinomiya, all of Japan

[73] Assignee: Toyo Soda Manufacturing Co., Ltd., Japan

[22] Filed: Aug. 13, 1973

[21] Appl. No.: 387,819

[30] Foreign Application Priority Data

Aug. 12, 1972 Japan ..... 47-80885

[52] U.S. Cl. .... 428/200; 260/27 EV; 260/28.5 AV; 427/148; 428/484; 428/488; 428/497; 428/498; 428/514; 428/531; 428/914

[51] Int. Cl.[2] ..... B41M 5/02

[58] Field of Search ..... 117/3.2, 3.4, 15, 168, 117/36.1; 101/157, 170, 467, 470; 156/230, 234, 277; 260/27 EV; 106/31, 32; 427/148; 428/484, 486, 488, 497, 498, 914, 200

[56] References Cited

UNITED STATES PATENTS

| | | | |
|---|---|---|---|
| 2,217,620 | 10/1940 | Jones | 101/157 |
| 2,261,339 | 11/1941 | Case | 101/157 |
| 2,862,832 | 12/1958 | Shepherd | 117/15 |
| 3,043,787 | 7/1962 | Bonvicini et al. | 260/27 EV |
| 3,086,873 | 4/1963 | Steinbrunner | 106/32 |
| 3,280,064 | 10/1966 | Hammer et al. | 117/168 |
| 3,367,896 | 2/1968 | Rosenbaum et al. | 106/31 |
| 3,368,989 | 2/1968 | Wissinger et al. | 117/36.1 |
| 3,406,137 | 10/1968 | Terry et al. | 106/32 |
| 3,519,463 | 7/1970 | Baum | 101/470 |
| 3,560,420 | 2/1971 | Tamura et al. | 117/168 |
| 3,595,943 | 7/1971 | Brunson et al. | 117/15 |
| 3,632,540 | 1/1972 | Unmuth et al. | 117/168 |
| 3,657,171 | 4/1972 | White | 117/168 |

*Primary Examiner*—Ralph Husack
*Attorney, Agent, or Firm*—Oblon, Fisher, Spivak, McClelland & Maier

[57] ABSTRACT

A heat printing sheet is prepared by coating a base with a molten printing composition which comprises 10 – 60% by weight of at least one tackifier selected from the group consisting of terpene resins, hydrogenated cyclopentadiene resins, cumarone-indene resins, phenol resins, styreneolefin copolymers, α-methylstyrene-vinyltoluene copolymers, rosins, polyol esters, hydrogenated rosins, hydrogenated rosin-polyol esters and rosin; 5 – 50% by weight of at least one wax selected from the group consisting of plant wax, petroleum wax, coal wax, synthetic wax; 10 – 60% by weight of an ethylene-vinyl acetate copolymer which contains 5 – 50% by weight of a vinylacetate component and which has a melt index of 4 – 1000 g/10 min, 5 – 40% by weight of a filler which is bendable with said tackifier, wax or ethylene-vinylacetate copolymer; and a pigment.

8 Claims, No Drawings

HEAT PRINTING SHEET

BACKGROUND OF THE INVENTION

1. Field of the Invention:

This invention relates to a heat printing sheet which is used for printing intellegence on a substrate by heat-pressing one side of a base whereby the intellegence is imprinted on the substrate by a printing composition which is coated on the side of the base which is not heat pressed.

2. Description of the Prior Art:

Heretofore, it has been known to print intellegence on a substrate by silk screen techniques. Printing marks applied by conventional means to fabrics have low cleaning fastness and are too easily removed by cleaning processes. One procedure has been considered in an attempt to overcome the difficulties associated with heat printing processes. However, when this procedure was used in a heat printing process, the mark obtained was blurred.

Thus, a need continues to exist for a composition which when applied to a base is amenable to heat printing procedures.

SUMMARY OF THE INVENTION

Accordingly, one object of this invention is to provide a printing sheet which when compressed with heat provides a clear mark which has high adhesive strength to a substrate and which is heat-printed at relatively low pressures so that no blooming of the printed mark is noticed.

Briefly, this object and other objects of this invention as hereinafter will become more readily apparent can be attained by providing a heat printing sheet which is coated on one side with a molten composition comprising 10 – 60% by weight of at least one tackifier selected from the group consisting of terpene resins, hydrogenated cyclopentadiene resins, phenol resins, styrene-olefin copolymers, α-methylstyrene-vinyltoluene copolymers, rosin-polyol esters such as rosin glycerine esters, rosins of pentaerythritol esters, hydrogenated rosins, hydrogenated rosin-polyol esters, rosins of maleic anhydride polyesters and derivatives thereof, and disproportionated rosins; 5 – 50% by weight of at least one wax of plant waxes, petroleum waxes, coal waxes, and synthetic waxes; 10 – 60% by weight of an ethylene-vinylacetate copolymer which contains 5 – 50% by weight of a vinylacetate component and which has a melt index of 4 – 1000 g/10 min., 5 – 40% by weight of a filler which is blendable with the tackifier, wax or ethylene-vinylacetate copolymer; and a pigment.

DESCRIPTION OF THE PREFERRED EMBODIMENTS

The ethylene-vinylacetate copolymer which is used in the printing composition of the invention is produced by a high pressure method, and comprises preferably 7 – 45% by weight, especially 20 – 40% by weight of a vinylacetate component. The copolymer has a melt index of 4 – 1000 g/10 min, preferably 15 – 400 g/10 min.

The tackifiers which are used in the printing composition of the invention are preferably terpene resins such as a β-pinene polymer having a molecular weight of 500 – 5000, hydrogenated cyclopetadiene resins having a molecular weight of 500 – 5000, dipentene polymers having a molecular weight of 1000 – 3000, phenol resins of a molecular weight of 300 – 3000, styrene-olefin copolymers having a molecular weight of 500 – 5000, and α-methylstyrene-vinyltoluene copolymers having a molecular weight of 500 – 5000. It is especially preferable to combine a rosin tackifier such as a rosin-polyol ester, a hydrogenated rosin, or a hydrogenated rosin-polyol ester with the other tackifier.

The waxes used in the printing composition of the invention preferably include plant waxes such as carnauba wax which has a molecular weight of 400 – 4000; petroleum waxes such as paraffin wax having a melting point of 100°F – 160°F; coal waxes such as a Fisher Tropsch wax which has a molecular weight of 500 – 1500; synthetic waxes such as polyethylene wax which has a molecular weight of 400 – 40,000, preferably 400 – 20,000, polypropylene wax which has a molecular weight of 400 – 4000, and low molecular weight oxidizing polypropylene compounds which have a molecular weight of 500 – 6000, preferably 1000 – 3000 and an acid value of 1.5 – 4.0.

The fillers used in the printing composition are preferably talc and clay.

Other additives can also be added to the printing composition depending upon the purpose desired. For example, when a heat resistant composition is required, it is especially preferable to add an anti-oxidant. Suitable anti-oxidants include 2,4-bis(n-octylthio)-6-(4′-hydroxy-3,5′-di-tert-butylanilino)-1,3,5-triazine, tetrakis [methylene-3(3′,5′-di-tert-butyl-4′-hydroxyphenyl propionate]methane, tri-nonylphenyl phosphate, distearyl thiodipropionate, 2,6-di-tert-butyl-p-cresol, 4,4′-thiobis(6-tert-butyl-m-cresol),N,N′-di-β-naphthyl-p-phenylenediamine, 4,4′-butylidene bis(6-tert-butyl-m-cresol) and 2-mercapto benzimidazol.

The pigments which are added to the heat printing composition are admixed with the tackifier, the wax, the ethylene-vinylacetate copolymer and the filler in a melt blending procedure. The choice of pigment, of course, depends upon the type of color desired. Preferably the inorganic pigments and organic pigments which are used have a high heat resistance.

In the process for preparing the printing composition the components are thoroughly mixed at temperatures of 90° – 230°C whereby the components melt. After the molten composition is cooled, it is stored as a solid. When the composition is to be used, the composition is melted and then coated on any suitable mark-engraved metallic roll by a heat melting process. The molten composition which has been coated on the unengraved surface of the roll is removed by a mechanical method such as a doctor knife from all portions of the metallic roll except the engraved portions of the roll. The molten composition is applied to a base such as paper by contacting the base with the rotating metallic roll. The molten composition is then cooled and a heat printing sheet having a solid composition suitable for heat printing techniques is obtained. Suitable bases for the heat printing sheet of this invention include Japanese paper, machine made paper, cloth, plastics, and the like. From an economic point of view paper is preferably used.

Marks or figures can be applied to a substrate by placing the heat printing sheet with the composition side down on a substrate such as paper, fabric made of a natural fiber, synthetic fiber or artificial fiber, plastic, film, wood, metal, porcelain or the like, and then pressing the back surface of the heat printing sheet with a heating device such as an iron.

The heat printing sheet of this invention has substantially improved properties in comparison to conventional heat printing sheets prepared by melt-blending polyethylene, ethylene-vinylacetate copolymer, chloronaphthalene, butyl rubber, ethyl cellulose, hydrogenated caster oil or the like, or silk screens which employ a printing solution of a thermoplastic resin and a modifier in a solvent.

Marks or figures of excellent clarity and sharpness can be heat printed on a fibrous substrate such as leather or the like because of the presence of the tackifier in the printing composition. Sharpness is defined as the ability to print a mark or figure on a substrate from the heat printing sheet within a short time. Furthermore, when the printed substrate is stretched or elongated, the printed marks or figures are not deformed because of the presence of the tackifier in the composition. The presence of the tackifier also prolongs the "printing life" of the sheet.

The presence of the rosins in the composition imparts low heat stability and low dispersibility characteristics to the composition. Thus, the presence of the rosins in the composition is preferred.

The presence of the waxes enhances the ability of the composition to imprint marks of excellent sharpness as well as providing excellent dispersibility of the pigment in the composition. The physical forms of the waxes which are used include white colored needle or plane crystals as well as other solid forms. On the other hand, micro-crystalline forms of wax such as those which consist of fine, delicate needles are unsuitable.

The presence of the filler prevents deformation of the printed mark when the mark shrinks after it has been printed on the base. Deformation of the printed mark which is caused by shrinking, disproportionation or cracking of the printed mark occurs when molten ink is coated over the printed mark.

The types of pigments which are useful include the conventional pigments.

The presence of the rubber-like elastomer in the composition yields a composition which is highly resistant to shrinking and crushing. Suitable rubber-like elastomers include butyl rubber, styrene-butadiene rubber and isoprene rubber.

With the printing composition of this invention intricately shaped marks can be clearly printed on substrates without blurring or deformation of the marks. The molten composition which is applied to the heat printing sheet should be a uniform mixture of the components and should be capable of easily being applied to the base of a heat printing sheet. The composition should also be capable of being easily transferred from a base to a substrate upon which it is firmly bonded. Thus, the molten composition should be able to be applied to a substrate such that stable marks are obtained on the substrate because of the substantial adhesive strength of the composition. Marks of sufficient thickness can be attained by heat printing the molten composition on a substrate. Generally, conventional heat printing compositions have had the tendency to blur when the molten compositions flow under heat printing conditions as the thickness of the molten compositions increase. However, the heat printing sheet of this invention does not have this disadvantage and marks of excellent clarity can be easily applied to substrates. Once the marks from the composition of the invention are firmly applied to a substrate they can not be peeled from the substrate. For example, when the marks are heat-printed on the cloth of a shirt, the printed marks do not peel from the fabric when the shirt is washed. In conclusion, the characteristics of marks applied to substrates from the heat printing sheet of the invention include excellent adhesive strength, softness, coherency and no tendency to blur.

Having generally described this invention, a further understanding can be obtained by reference to certain specific examples which are provided herein for purpose of illustration only and are not intended to be limiting unless limiting unless specified.

EXAMPLE 1

A 40% by weight amount of an ethylene-vinylacetate copolymer (28% by weight of the vinylacetate component) with a melt index of 150 g/10 min (hereinafter referred to as an EVA copolymer), 30% by weight of a hydrogenated rosin glycerine ester, 20% by weight of a polyethylene wax with a molecular weight of 500 and 10% by weight of a clay as a filler, were melted and blended in a stainless steel tank equipped with a stirrer. 15 Parts by weight of a pigment were added to 100 parts by weight of the stirred mixture, and the mixture was melt-blended at 150°C for 2 hours whereby a molten composition was obtained. A red pigment mixture and a black pigment mixture were separately prepared, each containing a portion of the molten composition. The molten composition which had been prepared was placed in the pan of a photogravure type coater at 150°C. The surface of a metallic printing roll which was compatable with the photogravure coater was engraved with a specific mark. A strip of paper was continuously passed through the gap between the printing roll and the roller press at a line speed of 50 m/min. As the paper contacted the applicators, the molten composition containing the red pigment was printed on the paper base in the shape of the mark. Subsequently, the molten composition containing the black pigment was printed on the paper base and a heat printing sheet was obtained. The printing surface of the heat printing sheet was placed on the cloth of a shirt and was heat-pressed from the back-surface of the sheet with a heated iron whereby a printed mark was transferred to the cloth. The cloth printed with the composition was washed ten times. However, the clarity of the mark did not change, by the washing as conducted under the procedures of the Japanese Industrial Standard L 0844 method.

EXAMPLES 2 – 8

In accordance with the procedure of Example 1, an ethylene-vinylacetate copolymer, a tackifier and a filler were heat-blended and a pigment was admixed with the mixture. A particular mark using the composition was coated on a paper base. The heat printing sheets obtained by this procedure were tested by test methods A, B and C. Test A involved the observation of the degree of blooming of the composition on the back-surface of the paper base. Test B involved the measurement of the degree of blocking of the printing composition. The test was conducted by keeping 1000 m of the treated paper in a continuously wound position at 30°C for 24 hours. After the paper was unwound, it was rewound and any indication of blocking was detected by the sound emitted by the paper as it was rewound. Test C involved a determination of the clarity of the printed composition whereby any deformation of the printed mark was indicated. A mark of the composition from the heat printing sheet was printed on the material of a white shirt made from a synthetic fiber by heat-pressing the sheet with a hot iron, and the cleaning fastness of the printed mark was tested at 45°C for 24 hours in a 2% aqueous solution of sodium alkylbenzene sulfonate. Test D measured the cleaning fastness of the printed mark by washing an article containing the mark ten times. A detergent was used and the degree of deformation and the degree of discoloring of the printed mark as well as the amount of the printed composition which was removed was observed when the printed material was washed by the Japanese Industrial Standard L0844 and L0848 methods.

| Example | Composition | | Test A | Test B | Test C | Test D |
|---|---|---|---|---|---|---|
| 2 | EVA copolymer (VA 15 wt.% MI 400) | 40 wt.% | no change | no change | no change | no change |
| | β-pinene polymer (MW = 1,000) | 15 wt.% | | | | |
| | polypropylene wax (MW = 2,400) | 20 wt.% | | | | |
| | clay (average 5μ) | 25 wt.% | | | | |
| | pigment: mixture (carbon black) = 10; 100 wt. part | | | | | |
| 3 | EVA copolymer (VA 30 wt.% MI 24) | 30 wt.% | no change | no change | no change | no change |
| | terpene resin (MW = 2,000) | 30 wt.% | | | | |
| | polypropylene wax (MW = 2,400) | 10 wt.% | | | | |
| | $CaCO_3$ (average 1μ) | 30 wt.% | | | | |
| | pigment: mixture (titanium oxide) = 14 : 100 wt. part | | | | | |
| 4 | EVA copolymer (VA 30 wt.% MI 600) | 20 wt.% | no change | no change | no change | no change |
| | hydrogenated dicyclopentadiene resin | 30 wt.% | | | | |
| | paraffin wax (157°F) | 30 wt.% | | | | |
| | $CaCO_3$ (average 1μ) | 20 wt.% | | | | |
| | pigment : mixture (phthalocyanine Blue) = 5 : 100 wt. part | | | | | |
| 5 | EVA copolymer (VA 7 wt.% MI 42) | 30 wt.% | no change | no change | no change | no change |
| | hydrogenated rosin | 10 wt.% | | | | |
| | hydrogenated rosin-glycerine ester | 20 wt.% | | | | |
| | paraffin wax (130°F) | 20 wt.% | | | | |
| | $CaCO_3$ (average 6μ) | 10 wt.% | | | | |
| | pigment : mixture (phthalocyanine Green) = 5 : 100 wt. part | | | | | |
| 6 | EVA copolymer (VA 24 wt.% MI 70) | 20 wt.% | no change | no change | no change | no change |
| | styrene-olefin copolymer (MW = 3,000) | 10 wt.% | | | | |
| | hydrogenated rosin glycerin ester | 20 wt.% | | | | |
| | polyethylene wax (MW = 1,000) | 20 wt.% | | | | |
| | clay (average 5μ) | 30 wt.% | | | | |
| | pigment : mixture (Watchung Red) = 15 : 100 wt. part | | | | | |
| 7 | EVA copolymer (VA 35 wt.% MI 240) | 25 wt.% | no change | no change | no change | no change |
| | α-methylstyrene vinyltoluene copolymer (MW = 2,500) | 15 wt.% | | | | |
| | low molecular weight styrene resin (MW = 2,000) | 15 wt.% | | | | |
| | synthetic wax (MP 108°C) | 35 wt.% | | | | |
| | clay (average 5μ) | 10 wt.% | | | | |
| | pigment : mixture (Brilliant Carmine) = 15 : 100 wt. part | | | | | |
| 8 | EVA copolymer (VA 35 wt.% MI 240) | 25 wt.% | no | no | no | no |
| | α-methylstyrene-vinyltoluene copolymer (MW = 2,500) | 15 wt.% | | | | |

-continued

| Example | Composition | | Test A | Test B | Test C | Test D |
|---|---|---|---|---|---|---|
| | hydrogenated dicyclopentadiene resin (MW = 3,000) | 15 wt.% | change | change | change | change |
| | paraffin wax (145°F) | 15 wt.% | | | | |
| | polyethylene wax (MW = 2,000) | 10 wt.% | | | | |
| | Talc (average 5μ) | 20 wt.% | | | | |
| | pigment : mixture (Benzidine yellow) = 15 : 100 wt. part | | | | | |
| 9 | EVA copolymer (VA 40 wt.% MI 60) | 40 wt.% | | | | |
| | styrene-olefin copolymer (MW 3,000) | 25 wt.% | no change | no change | no change | no change |
| | Fisher troph wax | 10 wt.% | | | | |
| | low molecular weight polypropylene oxidized compound (AV = 20, MW = 3,500) | 20 wt.% | | | | |
| | $BaSO_4$ | 5 wt.% | | | | |
| | pigment : butyl rubber: mixture 5 : 10 : 100 wt. part (carbon black) | | | | | |

VA: vinylacetate component
MI: melt index g/10 min.
MW: molecular weight
mixture: EVA copolymer, tackifier, filler and wax
pigment ratio: part by weight to 100 parts by weight of the mixture.

Having now fully described this invention, it will be apparent to one of ordinary skill in the art that many changes and modifications can be made thereto without departing from the spirit or scope of the invention as set forth herein.

What is claimed as new and intended to be covered by Letters Patent is:

1. A heat printing sheet, which comprises:

a substrate having coated thereon, a heat transferable composition in the form of characteristic marks or figures, said composition comprising 10 – 60 % by weight of at least one tackifier selected from the group consisting of terpene resins, hydrogenated cyclopentadiene resins, cumarone-indene resins, phenol resins, styrene-olefin copolymers, α-methylstyrene-vinyltoluene copolymers, rosins, polyol esters, hydrogenated rosin-polyol esters; 5 – 50% by weight of at least one wax selected from the group consisting of plant wax, petroleum wax, coal wax, synthetic wax; 10 – 60% by weight of an ethylene-vinyl acetate copolymer which contains 5 – 50% by weight of a vinylacetate component and which has a melt index of 4 – 1000 g/10 min; 5 – 40% by weight of a filler which is blendable with said tackifier, wax or ethylene-vinylacetate copolymer; and a pigment.

2. The heat printing sheet of claim 1, wherein said tackifier is a terpene polymer having a molecular weight of 500 – 5,000, a hydrogenated cyclopentadiene resin having a molecular weight of 500 – 5000, a phenol resin with a molecular weight of 300 – 3,000, a styrene-olefin copolymer having a molecular weight of 500 – 5000 or an α-methylstyrene-vinyltoluene copolymer having a molecular weight of 500 – 5000.

3. The heat printing sheet of claim 1, wherein said tackifier is a tackifier combination which contains a rosin type tackifier.

4. The heat printing sheet of claim 1, wherein said wax is carnauba wax having a molecular weight of 400 – 4000, paraffin wax having a melting point of 100°F – 160°F, a Fisher Tropsch wax having a molecular weight of 500 – 1500, a polyethylene wax having a molecular weight of 400 – 20,000 or a polypropylene wax having a molecular weight of 400 – 4000.

5. The heat printing sheet of claim 1, which further comprises an antioxidant.

6. The heat printing sheet of claim 1, wherein said wax is an oxidized low molecular weight polypropylene compound having a molecular weight of 500 – 6000.

7. The heat printing sheet of claim 1, which further comprises a rubber-like elastomer of butyl rubber, styrene-butadiene rubber, or isoprene rubber.

8. The heat printing sheet of claim 5, wherein said antioxidant is selected from the group consisting of 2,4-bis(n-octylthio)-6-(4′-hydroxy-3,5′-di-tert-butylanilino)-1,3,5-triazine, tetrakis methane, trinonylphenyl phosphate, distearyl thiodipropionate, 2,6-di-tert-butyl-p-cresol, 4,4′-thiobis(6-tert-butyl-m-cersol), N,N′-di-β-naphthyl-p-phenylenediamine, 4,4′-butylidene bis(6-tert-butyl-m-cresol) and 2-mercapto benzimidazol.

* * * * *